US011745518B2

(12) United States Patent
Tokai

(10) Patent No.: US 11,745,518 B2
(45) Date of Patent: Sep. 5, 2023

(54) PRINTING APPARATUS

(71) Applicant: Seiko Epson Corporation, Tokyo (JP)

(72) Inventor: Yoshitsugu Tokai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/653,727

(22) Filed: Mar. 7, 2022

(65) Prior Publication Data

US 2022/0288953 A1 Sep. 15, 2022

(30) Foreign Application Priority Data

Mar. 9, 2021 (JP) ..... 2021-037087

(51) Int. Cl.
*B41J 11/00* (2006.01)

(52) U.S. Cl.
CPC ..... *B41J 11/00214* (2021.01)

(58) Field of Classification Search
CPC ..... B41J 11/00214; B41J 11/00212; B41J 11/00218; B41J 2/2103; B41J 29/39
See application file for complete search history.

(56) References Cited

U.S. PATENT DOCUMENTS

2009/0244157 A1* 10/2009 Hishida ..... B41J 11/00214 250/365

FOREIGN PATENT DOCUMENTS

JP 2009-208227 9/2009

* cited by examiner

*Primary Examiner* — Bradley W Thies
(74) *Attorney, Agent, or Firm* — WORKMAN NYDEGGER

(57) ABSTRACT

A printing apparatus that performs a first control of performing discharge of ultraviolet curable ink from a printing head and irradiation of ultraviolet rays from an ultraviolet irradiation unit while performing a first movement along a main scanning direction and a second movement along a sub scanning direction from a print start position side to a print end position side, and a second control of performing irradiation of ultraviolet rays from the ultraviolet irradiation unit without performing discharge of ultraviolet curable ink from the printing head while performing the first movement and the second movement from the print end position side to the print start position side, and in which a movement speed of the first movement in the second control is faster than a movement speed of the first movement in the first control.

11 Claims, 9 Drawing Sheets

PRINTING APPARATUS

The present application is based on, and claims priority from JP Application Serial Number 2021-037087, filed Mar. 9, 2021, the disclosure of which is hereby incorporated by reference herein in its entirety.

BACKGROUND

1. Technical Field

The disclosure relates to a printing apparatus.

2. Related Art

Printing apparatuses of various configurations have been used. Among these, there is a printing apparatus that forms an image by discharging ultraviolet curable ink onto a medium. For example, as a printing apparatus having such a configuration, JP-A-2009-208227 discloses an inkjet printer that performs discharge of ultraviolet curable ink and irradiation of ultraviolet rays while reciprocating an ultraviolet curable ink discharging unit and an ultraviolet irradiation unit to form an image.

Here, in the printing apparatus that discharges ultraviolet curable ink onto a medium to form an image, if the amount of irradiation of ultraviolet rays is insufficient, curing of the ultraviolet curable ink may be insufficient, and therefore the image may be damaged due to something that touched the ultraviolet curable ink, and anything that touched the ultraviolet curable ink may become dirty. Therefore, the inkjet printer of JP-A-2009-208227 is configured to increase the amount of ultraviolet rays irradiated from the ultraviolet irradiation unit when the ultraviolet irradiation unit is moved in a return direction in the reciprocating movement. However, if the amount of ultraviolet rays is increased, the amount of ultraviolet rays reaching the ultraviolet curable ink discharging unit also increases, and the ultraviolet curable ink in a nozzle of the discharging unit may be cured to cause nozzle clogging or the like. Therefore, there is a limit to increase irradiation amount of ultraviolet rays irradiated from the ultraviolet irradiation unit. On the other hand, if speed of the reciprocating movement of the ultraviolet irradiation unit is reduced in order to irradiate the ultraviolet rays irradiated from the ultraviolet irradiation unit for a long period of time, throughput is significantly reduced. Therefore, an advantage of some aspects of the disclosure is to securely cure ultraviolet curable ink while suppressing a decrease in throughput.

SUMMARY

In order to solve the above-described issue, a printing apparatus according to the present disclosure includes a printing head configured to reciprocate in a first direction and configured to discharge ultraviolet curable ink onto a medium, an ultraviolet irradiation unit configured to reciprocate in the first direction along with the printing head, and configured to irradiate the ultraviolet curable ink discharged onto the medium with ultraviolet rays, a first movement unit configured to move the printing head and the ultraviolet irradiation unit in the first direction, a second movement unit configured to relatively move the printing head and the ultraviolet irradiation unit, and the medium, in a second direction that intersects with the first direction, and a control unit configured to control a first movement that is a movement of the printing head and the ultraviolet irradiation unit in the first direction, a second movement that is a relative movement between, the printing head and the ultraviolet irradiation unit, and the medium, in the second direction, discharge of the ultraviolet curable ink from the printing head, and irradiation of the ultraviolet rays from the ultraviolet irradiation unit, wherein the control unit is configured to perform a first control of performing discharge of the ultraviolet curable ink from the printing head and irradiation of the ultraviolet rays from the ultraviolet irradiation unit while performing the first movement and the second movement from a print start position side to a print end position side of the medium, and a second control of performing irradiation of the ultraviolet rays from the ultraviolet irradiation unit without performing discharge of the ultraviolet curable ink from the printing head while performing the first movement and the second movement from the print end position side to the print start position side, and a second speed that is a movement speed of the first movement of the printing head and the ultraviolet irradiation unit in the second control is faster than a first speed that is a movement speed of the first movement of the printing head and the ultraviolet irradiation unit in the first control.

Further, in order to solve the above-described issue, a printing apparatus according to the present disclosure includes a printing head configured to reciprocate in a first direction and configured to discharge ultraviolet curable ink onto a medium, an ultraviolet irradiation unit configured to reciprocate in the first direction along with the printing head, and configured to irradiate the ultraviolet curable ink discharged onto the medium with ultraviolet rays, a first movement unit configured to move the printing head and the ultraviolet irradiation unit in the first direction, a second movement unit configured to relatively move the printing head and the ultraviolet irradiation unit, and the medium, in a second direction that intersects with the first direction, and a control unit configured to control a first movement that is a movement of the printing head and the ultraviolet irradiation unit in the first direction, a second movement that is a relative movement between, the printing head and the ultraviolet irradiation unit, and the medium, in the second direction, discharge of the ultraviolet curable ink from the printing head, and irradiation of the ultraviolet rays from the ultraviolet irradiation unit, wherein the control unit is configured to perform a first control of performing discharge of the ultraviolet curable ink from the printing head and irradiation of the ultraviolet rays from the ultraviolet irradiation unit while performing performing the first movement and the second movement from a print start position side to a print end position side of the medium, and a second control of moving the printing head and the ultraviolet irradiation unit from the print end position side to the print start position side, and a third control of performing irradiation of the ultraviolet rays from the ultraviolet irradiation unit without performing discharge of the ultraviolet curable ink from the printing head while performing the first movement and the second movement from the print start position side to the print end position side, and a second speed that is a movement speed of the printing head and the ultraviolet irradiation unit in the third control is faster than a first speed that is a movement speed of the first movement of the printing head and the ultraviolet irradiation unit in the first control.

DESCRIPTION OF EXEMPLARY EMBODIMENTS

Figure 1:
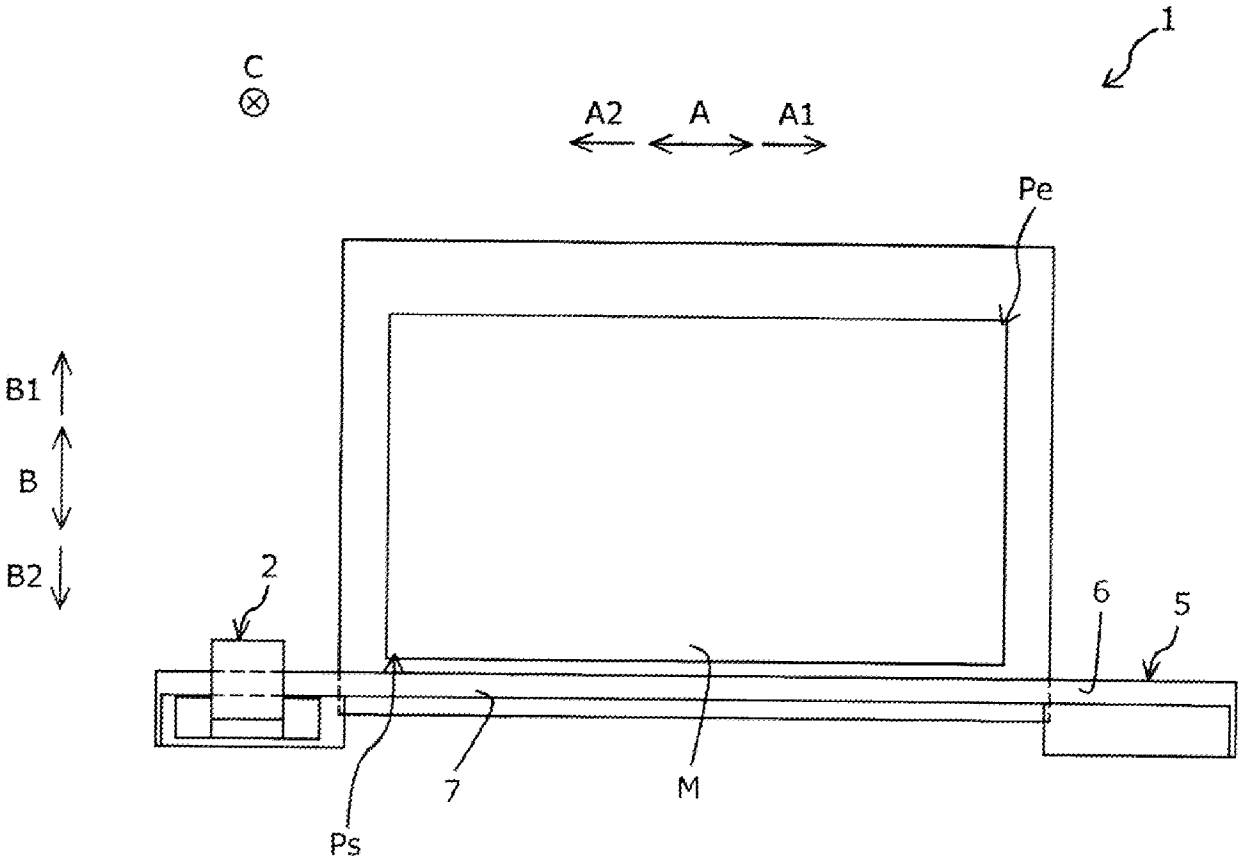
FIG. 1 is a plan view of a printing apparatus according to an embodiment of the present disclosure.

First, the present disclosure will be schematically described.

In order to solve the above-described issue, a printing apparatus according to a first aspect of the present disclosure includes a printing head configured to reciprocate in a first direction and configured to discharge ultraviolet curable ink onto a medium, an ultraviolet irradiation unit configured to reciprocate in the first direction along with the printing head, and configured to irradiate the ultraviolet curable ink discharged onto the medium with ultraviolet rays, a first movement unit configured to move the printing head and the ultraviolet irradiation unit in the first direction, a second movement unit configured to relatively move the printing head and the ultraviolet irradiation unit, and the medium, in a second direction that intersects with the first direction, and a control unit configured to control a first movement that is a movement of the printing head and the ultraviolet irradiation unit in the first direction, a second movement that is a relative movement between, the printing head and the ultraviolet irradiation unit, and the medium, in the second direction, discharge of the ultraviolet curable ink from the printing head, and irradiation of the ultraviolet rays from the ultraviolet irradiation unit, wherein the control unit is configured to perform a first control of performing discharge of the ultraviolet curable ink from the printing head and irradiation of the ultraviolet rays from the ultraviolet irradiation unit while performing the first movement and the second movement from a print start position side to a print end position side of the medium, and a second control of performing irradiation of the ultraviolet rays from the ultraviolet irradiation unit without performing discharge of the ultraviolet curable ink from the printing head while performing the first movement and the second movement from the print end position side to the print start position side, and a second speed that is a movement speed of the first movement of the printing head and the ultraviolet irradiation unit in the second control is faster than a first speed that is a movement speed of the first movement of the printing head and the ultraviolet irradiation unit in the first control.

According to this aspect, in addition to the first control of performing discharge of the ultraviolet curable ink from the printing head and irradiation of the ultraviolet rays from the ultraviolet irradiation unit while performing the first movement and the second movement from the print start position side to the print end position side, the second control of performing irradiation of the ultraviolet rays from the ultraviolet irradiation unit without performing discharge of the ultraviolet curable ink from the printing head while performing the first movement and the second movement from the end position side to the print start position side, can be performed. Therefore, in addition to the first control, the second control can firmly irradiate ultraviolet rays, and ultraviolet curable ink can be securely cured. Further, the second speed that is a movement speed of the first movement of the printing head and the ultraviolet irradiation unit in the second control is faster than the first speed that is a movement speed of the first movement of the printing head and the ultraviolet irradiation unit in the first control. Therefore, the second control can be performed in a short time, and a decrease in throughput can be suppressed.

In the printing apparatus according to a second aspect of the present disclosure, a second relative movement speed that is a speed of the relative movement of the second movement in the second control, is faster than a first relative movement speed that is a speed of the relative movement of the second movement in the first control, in the first aspect.

According to this aspect, the second relative movement speed that is a speed of the relative movement of the second movement in the second control, is faster than the first relative movement speed that is a speed of the relative movement of the second movement in the first control. Therefore, in addition to the second speed in the second control, the second relative movement speed in the second control is also fast, so that the second control can be performed at particularly short time, and a decrease in throughput can be effectively suppressed.

In the printing apparatus according to a third aspect of the present disclosure, the control unit performs the first control and the second control such that a curing degree of the ultraviolet curable ink discharged onto the medium, after the control unit performs the second control subsequently to the first control, is equal to or greater than 97%, in the first or second aspect.

According to this aspect, the first control and the second control are performed such that a curing degree of the ultraviolet light curable ink discharged onto the medium, after the control unit performs the second control subsequently to the first control, is equal to or greater than 97%. Therefore, it is suppressed that the ultraviolet curable ink discharged onto the medium is insufficiently cured after the second control has been performed, and therefore an image is prevented from being damaged or anything that touched the ultraviolet curable ink is prevented from becoming dirty.

In the printing apparatus according to a fourth aspect of the present disclosure, the control unit performs control such that an integrated irradiation amount of the ultraviolet rays from the ultraviolet irradiation unit in the second control is less than an integrated irradiation amount of the ultraviolet rays from the ultraviolet irradiation unit in the first control, in any one of the first to third aspects.

According to this aspect, an integrated irradiation amount of the ultraviolet rays from the ultraviolet irradiation unit in the second control is controlled to be less than an integrated irradiation amount of the ultraviolet rays from the ultraviolet irradiation unit in the first control. In other words, the second control can be performed in a short period of time, for example, when irradiation intensity of the ultraviolet rays from the ultraviolet irradiation unit is made equal in the first control and the second control. As a result, a decrease in throughput can be effectively suppressed.

The printing apparatus according to a fifth aspect of the present disclosure includes a cleaning unit configured to clean the printing head according to the control by the control unit, and the control unit performs control such that irradiation intensity of the ultraviolet rays from the ultraviolet irradiation unit in the second control is higher than irradiation intensity of the ultraviolet rays from the ultraviolet irradiation unit in the first control, and performs control such that a cleaning frequency of the printing head by the cleaning unit in the second control is higher than a cleaning frequency of the printing head by the cleaning unit in the first control, in any one of the first to fourth aspects.

According to this aspect, irradiation intensity of the ultraviolet rays from the ultraviolet irradiation unit in the second control is controlled to be higher than irradiation intensity of the ultraviolet rays from the ultraviolet irradiation unit in the first control, and a cleaning frequency of the printing head by the cleaning unit in the second control is controlled to be higher than a cleaning frequency of the printing head by the cleaning unit in the first control. When irradiation intensity is increased, ultraviolet rays may reach the nozzles or the like of the printing head and ultraviolet light curable ink in the nozzle may be cured, but by increasing the cleaning frequency, the cured ultraviolet light curable ink can be appropriately removed, and nozzle clogging or the like can be prevented from occurring.

A printing apparatus according to a sixth aspect of the present disclosure includes a printing head configured to reciprocate in a first direction and configured to discharge ultraviolet curable ink onto a medium, an ultraviolet irradiation unit configured to reciprocate in the first direction along with the printing head, and configured to irradiate the ultraviolet curable ink discharged onto the medium with ultraviolet rays, a first movement unit configured to move the printing head and the ultraviolet irradiation unit in the first direction, a second movement unit configured to relatively move the printing head and the ultraviolet irradiation unit, and the medium, in a second direction that intersects with the first direction, and a control unit configured to control a first movement that is a movement of the printing head and the ultraviolet irradiation unit in the first direction, a second movement that is a relative movement between, the printing head and the ultraviolet irradiation unit, and the medium, in the second direction, discharge of the ultraviolet curable ink from the printing head, and irradiation of the ultraviolet rays from the ultraviolet irradiation unit, wherein the control unit is configured to perform a first control of performing discharge of the ultraviolet curable ink from the printing head and irradiation of the ultraviolet rays from the ultraviolet irradiation unit while performing the first movement and the second movement from a print start position side to a print end position side of the medium, and a second control of moving the printing head and the ultraviolet irradiation unit from the print end position side to the print start position side, and a third control of performing irradiation of the ultraviolet rays from the ultraviolet irradiation unit without performing discharge of the ultraviolet curable ink from the printing head while performing the first movement and the second movement from the print start position side to the print end position side, and a second speed that is a movement speed of the printing head and the ultraviolet irradiation unit in the third control is faster than a first speed that is a movement speed of the first movement of the printing head and the ultraviolet irradiation unit in the first control.

According to this aspect, in addition to the first control of performing discharge of the ultraviolet curable ink from the printing head and irradiation of the ultraviolet rays from the ultraviolet irradiation unit while performing the first movement and the second movement from a print start position side to a print end position side, and the second control of moving the printing head and the ultraviolet irradiation unit from the print end position side to the print start position side, the third control of performing irradiation of the ultraviolet rays from the ultraviolet irradiation unit without performing discharge of the ultraviolet curable ink from the printing head while performing the first movement and the second movement from the print start position side to the print end position side, can be performed. Therefore, in addition to the first control, in the third control, ultraviolet rays can be firmly irradiated, and ultraviolet curable ink can be surely cured. Further, the second speed that is a movement speed of the first movement of the printing head and the ultraviolet irradiation unit in the third control is faster than the first speed that is a movement speed of the first movement of the printing head and the ultraviolet irradiation unit in the first control. Therefore, the third control can be performed in a short time, and a decrease in throughput can be suppressed.

In the printing apparatus according to a seventh aspect of the present disclosure, a second relative movement speed that is a speed of the relative movement of the second movement in the third control, is faster than a first relative movement speed that is a speed of the relative movement of the second movement in the first control, in the sixth aspect.

According to this aspect, the second relative movement speed that is a speed of the relative movement of the second movement in the third control, is faster than the first relative movement speed that is a speed of the relative movement of the second movement in the first control. Therefore, in addition to the second speed in the third control, the second relative movement speed in the third control is also fast, so that the third control can be performed at particularly short time, and a decrease in throughput can be effectively suppressed.

In the printing apparatus according to an eighth aspect of the present disclosure, the control unit performs the first control, the second control, and the third control such that a curing degree of the ultraviolet curable ink discharged onto the medium, after the control unit performs the third control subsequently to the first control and the second control, is equal to or greater than 97%, in the sixth or seventh aspect.

According to this aspect, the first control, the second control, and the third control are performed such that a curing degree of the ultraviolet curable ink discharged onto the medium on which the third control was performed after the first control and the second control were performed, is equal to or greater than 97%. Therefore, it is suppressed that the ultraviolet curable ink discharged onto the medium is insufficiently cured after the third control is performed, and therefore an image is prevented from being damaged or anything that touched the ultraviolet curable ink is prevented from becoming dirty.

In the printing apparatus according to a ninth aspect of the present disclosure, the control unit performs control such that an integrated irradiation amount of the ultraviolet rays from the ultraviolet irradiation unit in the third control is less than an integrated irradiation amount of the ultraviolet rays from the ultraviolet irradiation unit in the first control, in any one of the sixth to eighth aspects.

According to this aspect, an integrated irradiation amount of the ultraviolet rays from the ultraviolet irradiation unit in the third control is controlled to be less than an integrated irradiation amount of the ultraviolet rays from the ultraviolet irradiation unit in the first control. In other words, the third control can be performed in a short period of time, for example, when irradiation intensity of ultraviolet rays from the ultraviolet irradiation unit is made equal in the first control and the third control. As a result, a decrease in throughput can be effectively suppressed.

The printing apparatus according to a tenth aspect of the present disclosure includes a cleaning unit configured to clean the printing head according to the control by the control unit, and the control unit performs control such that irradiation intensity of the ultraviolet rays from the ultraviolet irradiation unit in the third control is higher than irradiation intensity of the ultraviolet rays from the ultraviolet irradiation unit in the first control, and performs control such that a cleaning frequency of the printing head by the cleaning unit in the third control is higher than a cleaning frequency of the printing head by the cleaning unit in the first control, in any one of the sixth to ninth aspects.

According to this aspect, irradiation intensity of the ultraviolet rays from the ultraviolet irradiation unit in the third control is controlled to be higher than irradiation intensity of the ultraviolet rays from the ultraviolet irradiation unit in the first control, and a cleaning frequency of the printing head by the cleaning unit in the third control is controlled to be higher than a cleaning frequency of the printing head by the cleaning unit in the first control. When irradiation intensity is increased, ultraviolet rays may reach the nozzle or the like of the printing head, and ultraviolet curable ink in the nozzle may be cured. However, by increasing the cleaning frequency, the cured ultraviolet curable ink can be appropriately removed, and thus nozzle clogging or the like can be prevented from occurring.

In the printing apparatus according to an eleventh aspect of the present disclosure, the control unit performs the first control such that a curing degree of the ultraviolet curable ink discharged onto the medium, after the control unit performs the first control, is equal to or greater than 50%, in any one of the sixth to tenth aspects.

According to this aspect, the first control is performed such that a curing degree of the ultraviolet curable ink discharged onto the medium, after the control unit performs the first control, is equal to or greater than 50%. As a result, the ultraviolet curable ink discharged onto the medium on which the first control has been performed is sufficiently temporarily cured to suppress position shift and bleeding. Therefore, deterioration of image quality is suppressed.

Preferred embodiments of the present disclosure will be described below with reference to the accompanying drawings. First, an overview of a printing apparatus 1 according to an embodiment of the present disclosure will be described with reference to FIGS. 1 to 5.

Figure 2:
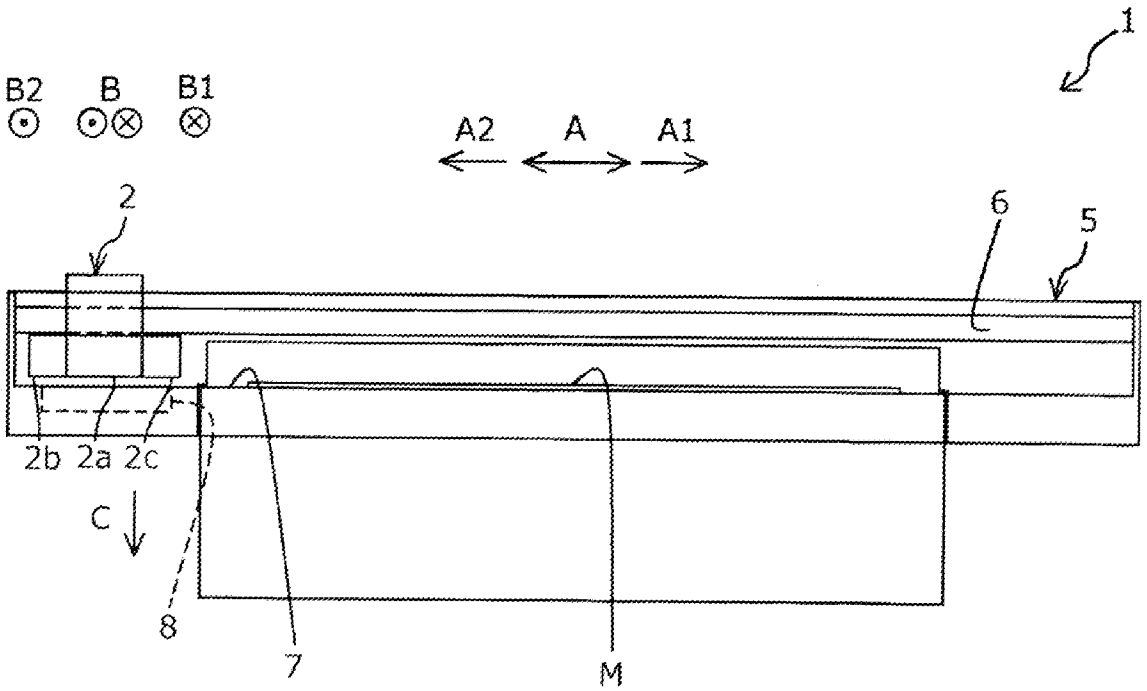
FIG. 2 is a schematic front view of the printing apparatus according to the embodiment of the present disclosure.

As illustrated in FIGS. 1 and 2, the printing apparatus 1 according to the present embodiment includes a placement unit 7 on which a medium M to be printed is placed. Further, the printing apparatus 1 according to the present embodiment includes a carriage 2 provided with a printing head 3 illustrated in FIG. 3 and an ultraviolet irradiation unit 4 illustrated in FIGS. 3, 4, and 5. As illustrated in FIGS. 1 and 2, the carriage 2 is attached to a guide rail 6 of a gantry 5. Here, the carriage 2 is configured to reciprocate in a forward direction A1 and a return direction A2 along a main scanning direction A that corresponds to an extension direction of the guide rail 6. Further, the gantry 5 is configured to reciprocate in a direction B1 and a direction B2 along a sub scanning direction B that is orthogonal to the main scanning direction A with respect to the placement unit 7 in a state of mounting thereon the carriage 2 reciprocally movable in the main scanning direction A.

Here, FIG. 1 illustrates a state in which the carriage 2 is at a home position. As illustrated in FIG. 2, the home position is provided with a cleaning unit 8 provided with a wiper, a suction cap, and the like capable of cleaning the printing head 3. The printing apparatus 1 according to the present embodiment discharges ultraviolet curable ink from the printing head 3 toward the medium M and causes the ultraviolet irradiation unit 4 to irradiate ultraviolet rays to form an image on the medium M while repeatedly perform the reciprocating movement of the carriage 2 along the main scanning direction A and the movement of the gantry 5 along the sub scanning direction B by a movement amount corresponding to a predetermined number of passes. A discharge direction C of the ultraviolet curable ink from the printing head 3 is vertically downward.

By driving in this manner, the printing apparatus 1 according to the present embodiment moves the gantry 5 along the sub scanning direction B from a print start position Ps side to a print end position Pe illustrated in FIG. 1 while moving the carriage 2 reciprocally along the main scanning direction A, and discharges the ultraviolet curable ink from the printing head 3 and irradiates with ultraviolet rays from the ultraviolet irradiation unit 4, thereby forming an image on the medium M. Here, to move the gantry 5 from the print start position Ps side to the print end position Pe side also means, in addition to move the gantry 5 from the print start position Ps to the print end position Pe, to move the gantry 5 from a position before or past the print start position Ps to a position before or past the print end position Pe in the direction B1, which is the movement direction of the gantry 5. Similarly, to move the gantry 5 from the print end position Pe side to the print start position Ps side also means, in addition to move the gantry 5 from the print end position Pe to the print start position Ps, to move the gantry 5 from the position before or past the print end position Pe to the position before or past the print start position Ps in the direction B2, which is the movement direction of the gantry 5.

Nevertheless, the present disclosure is not limited to such a configuration. For example, instead of a configuration in which the gantry 5 is moved along the sub scanning direction B with respect to the medium M placed on the placement unit, the medium M placed on the placement unit may be configured to move along the sub scanning direction B. Further, the medium M may be transported in a transport direction corresponding to the sub scanning direction B by a transport roller or the like. A detailed printing method using the printing apparatus 1 according to the present embodiment will be described later.

Here, in the printing apparatus 1 according to the present embodiment, as the ultraviolet curable ink, black ink, cyan ink, magenta ink, yellow ink, gray ink, red ink, light cyan ink, and light magenta ink, which are color ink for forming an image on the medium M, white ink for forming a base layer before or after forming the image on the medium M, and burnish ink (transparent ink) for coating the image formed on the medium M, can be used. Then, an image can be formed on the medium M in a mode in which an image is formed on the medium M using only color ink, a mode in which an image is formed on the medium M using color ink and white ink, a mode in which an image is formed on the medium M using color ink and burnish ink, and a mode in which an image is formed on the medium M using color ink, white ink, and burnish ink.

In the printing apparatus 1 of the present embodiment, each color ink, white ink, and burnish ink contains an ultraviolet curable material that is cured by being irradiated with ultraviolet rays, and is the ultraviolet curable ink. However, ink other than the ultraviolet curable ink may be used as any of each color ink, white ink, and varnish ink. Further, the type of the ultraviolet curable material contained in the ultraviolet curable ink and the types of other contained materials are not particularly limited.

Here, in the printing apparatus 1 of the present embodiment, as the medium M, special paper and the like for ink-jet printing, such as plain paper, pure paper, and glossy paper can be used. Other materials that can be used as the medium M include, for example, plastic films without a surface treatment applied to serve as an ink absorption layer for ink-jet printing, as well as substrates such as paper being applied a plastic coating and substrates being bonded a plastic film. Such plastic materials include, but are not limited to, for example, polyvinyl chloride, polyethylene terephthalate, polycarbonate, polystyrene, polyurethane, polyethylene, and polypropylene. Further, as the medium M, a printing-target material may be used. The term "printable material" refers to a fabric, a garment, and other clothing products which can be printed. Fabrics includes natural fibers such as cotton, silk and wool, chemical fibers such as nylon, or composite fibers of natural fibers and chemical fibers such as woven cloths, knit fabrics, and non-woven cloths. Garments and other clothing products include sewn products, such as a T-shirt, handkerchief, scarf, towel, handbag, fabric bag, and furniture-related products including a curtain, sheet, and bed cover, as well as fabric before and after cutting to serve as pieces of cloth before sewing.

Figure 3:
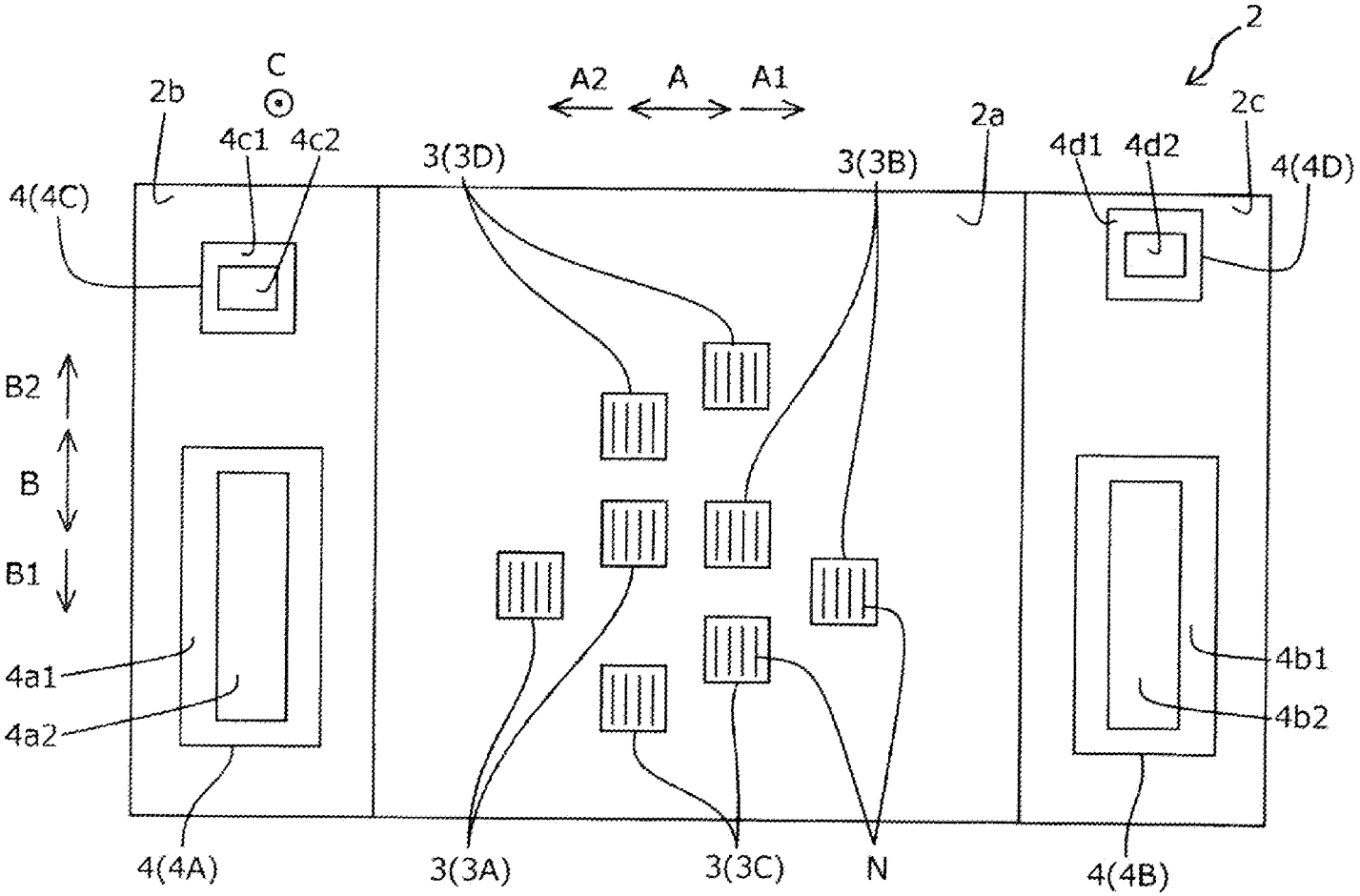
FIG. 3 is a schematic bottom view of a carriage of the printing apparatus according to the embodiment of the present disclosure.
Figure 4:
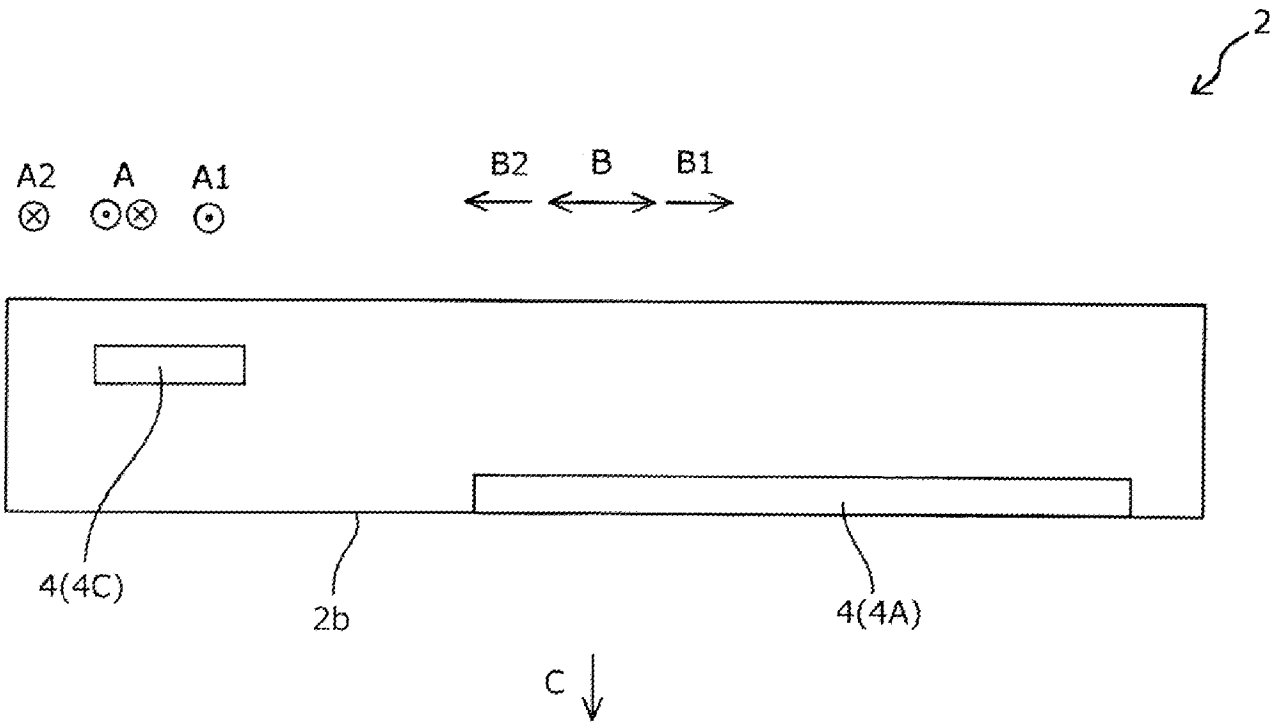
FIG. 4 is a schematic side view of the carriage of the printing apparatus according to the embodiment of the present disclosure.
Figure 5:
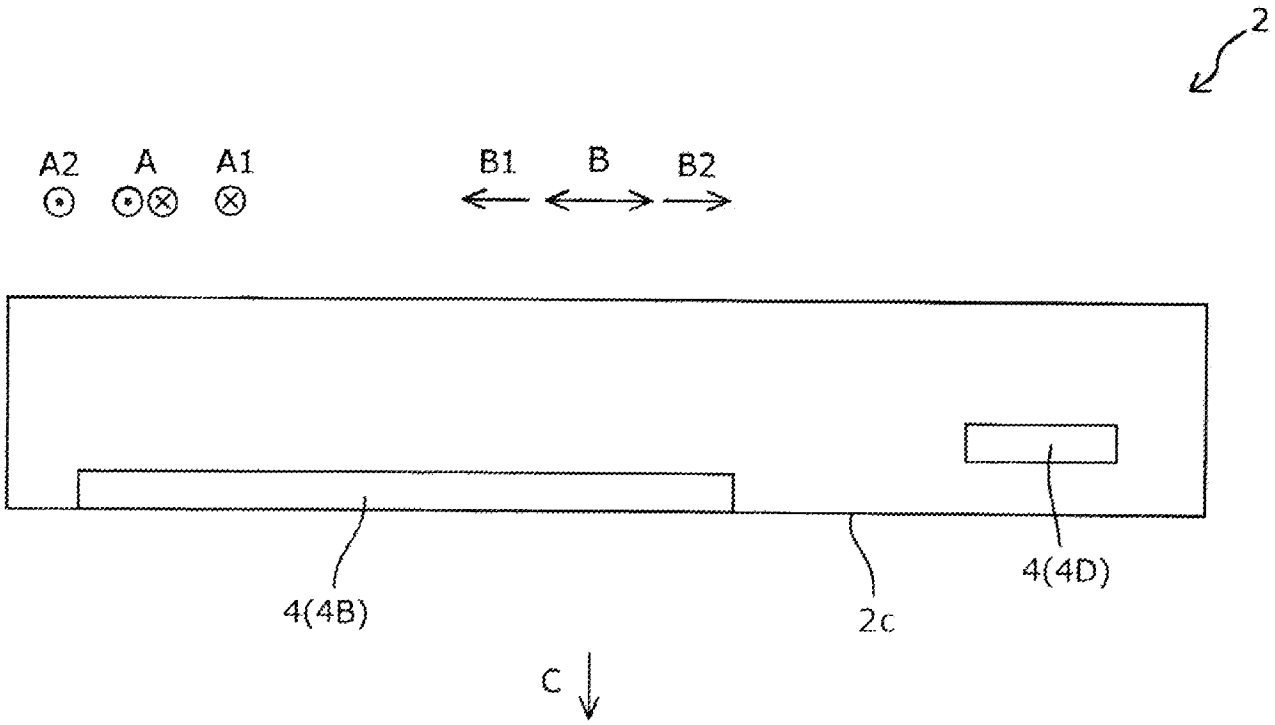
FIG. 5 is a schematic side view of the carriage of the printing apparatus according to the embodiment of the present disclosure on the opposite side of FIG. 4.

Next, a detailed configuration of the carriage 2 will be described below with reference to FIGS. 2 to 5. As illustrated in FIGS. 2 and 3, the carriage 2 includes a region 2*a*, and a region 2*b* and a region 2*c* provided on both sides of the region 2*a* in the main scanning direction A. Then, as illustrated in FIG. 3, a plurality of printing heads 3 are provided in the region 2*a*, an ultraviolet irradiation unit 4A and an ultraviolet irradiation unit 4C are provided in the region 2*b*, and an ultraviolet irradiation unit 4B and an ultraviolet irradiation unit 4D are provided in the region 2*c*.

FIG. 3 is a view of the carriage 2 as viewed from a nozzle surface side of the printing head 3 provided with a nozzle N. Specifically, two printing heads 3A that discharge black ink, cyan ink, magenta ink, and yellow ink, two printing heads 3B that discharge gray ink, red ink, light cyan ink, and light magenta ink, two printing heads 3C that discharge white ink, and two printing heads 3D that discharge burnish ink are provided in the region 2*a*. Two printing heads 3A, two printing heads 3B, two printing heads 3C, and two printing heads 3D are arranged such that a portion of the nozzle N overlaps each other when viewed from the main scanning direction A. The printing heads 3C, the printing heads 3A and the printing heads 3B, and the printing heads 3D are arranged in this order from a front side to a rear side in the direction B1. Further, in each of the two printing heads 3A, nozzle rows are arranged in the order of a nozzle row, which is a row of the nozzle N, that discharges cyan ink, a nozzle row that discharges magenta ink, a nozzle row that discharges yellow ink, and a nozzle row that discharges black ink, from left to right in FIG. 3 in the main scanning direction A. In each of the two printing heads 3B, nozzle rows are arranged in the order of a nozzle row that discharges gray ink, a nozzle row that discharges red ink, a nozzle row that discharges light magenta ink, and a nozzle row that discharges light cyan ink, from left to right in FIG. 3 in the main scanning direction A.

Further, the ultraviolet irradiation unit 4A provided in the region 2*b* and the ultraviolet irradiation unit 4B provided in the region 2*c* are arranged on both sides of each of the printing heads 3A and printing heads 3B in the main scanning direction A, and are arranged to overlap the printing heads 3C, and the printing heads 3A and the printing heads 3B when viewed from the main scanning direction A. Further, the ultraviolet irradiation unit 4C provided in the region 2*b* and the ultraviolet irradiation unit 4D provided in the region 2*c* are arranged at positions that are offset from each other in the main scanning direction A. However, a part of a light source 4*c*2 and a part of a light source 4*d*2 overlap when viewed from the main scanning direction A. Further, both the ultraviolet irradiation unit 4C and the ultraviolet irradiation unit 4D are arranged at a rear side of the printing head 3D in the direction B1, and as can be seen by comparing FIGS. 4 and 5, an installation position of the ultraviolet irradiation unit 4D in the vertical direction is lower than an installation position of the ultraviolet irradiation unit 4C in the vertical direction. Each ultraviolet irradiation unit includes a light source and a cover that covers the light source. The ultraviolet irradiation unit 4A includes a cover 4*a*1 and a light source 4*a*2, the ultraviolet irradiation unit 4B includes a cover 4*b*1 and a light source 4*b*2, the ultraviolet irradiation unit 4C includes a cover 4*c*1 and the light source 4*c*2, and the ultraviolet irradiation unit 4D includes a cover 4*d*1 and the light source 4*d*2.

Irradiation intensity of ultraviolet rays of the ultraviolet irradiation unit 4A and the ultraviolet irradiation unit 4B is stronger than irradiation intensity of ultraviolet rays of the ultraviolet irradiation unit 4C and the ultraviolet irradiation unit 4D. Further, the irradiation intensity of ultraviolet irradiation unit 4D is equal to the irradiation intensity of ultraviolet rays of the ultraviolet irradiation unit 4C, but as described above, the installation position of the ultraviolet irradiation unit 4D in the vertical direction is lower than the installation position of the ultraviolet irradiation unit 4C, and therefore relative irradiation intensity of the ultraviolet irradiation unit 4D on a surface of the medium M with respect to the ultraviolet irradiation unit 4C is slightly stronger than that of the ultraviolet irradiation unit 4C. In the printing apparatus 1 according to the present embodiment, the carriage 2 is configured as described above, but is not limited to such a configuration. Arrangement and number of the printing head 3 and the ultraviolet irradiation unit 4 provided on the carriage 2 are not particularly limited, and as long as the printing head 3 and the ultraviolet irradiation unit 4 are both configured to move back and forth along the main scanning direction A, they may not be arranged on one carriage 2.

Figure 6:
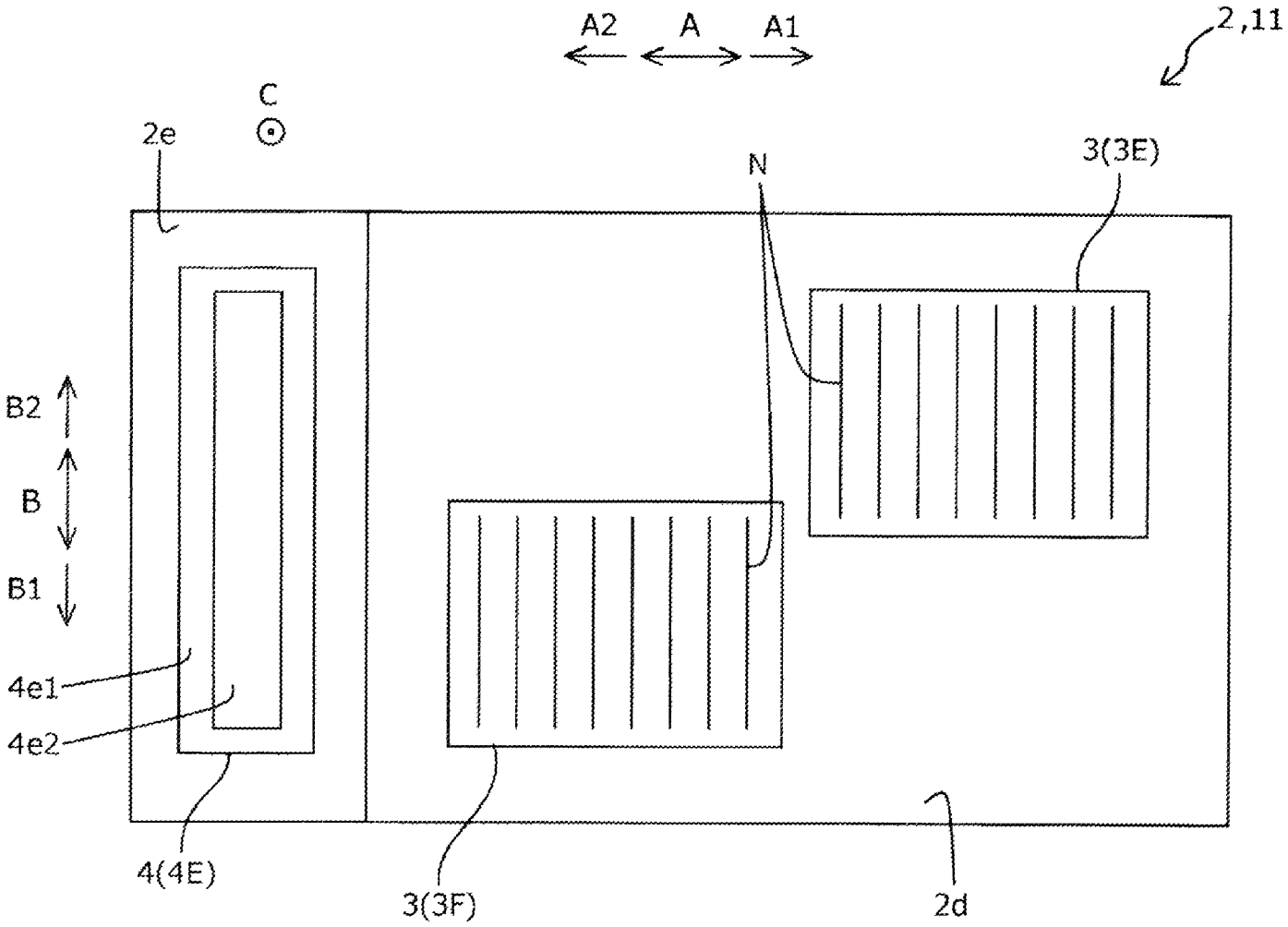
FIG. 6 is a schematic bottom view of an example of a carriage of a printing apparatus according to another embodiment from the printing apparatus illustrated in FIGS. 1 to 5.

For example, the carriage 2 may have a configuration as illustrated in FIG. 6. FIG. 6 is a diagram illustrating the carriage 2 of a printing apparatus 11 according to an embodiment of the present disclosure. In the carriage 2 of the printing apparatus 11, two printing heads 3E and 3F are provided in a region 2*d*, and an ultraviolet irradiation unit 4E is provided in a region 2*e*. FIG. 6 is a view of the carriage 2 viewed from the nozzle surface side of the printing head 3, and in detail, the printing head 3E that discharges black ink, cyan ink, magenta ink, yellow ink, gray ink, red ink, light cyan ink, and light magenta ink and the printing head 3F that discharges white ink and burnish ink are provided in the region 2*d*. Two printing head 3E and printing head 3F are arranged in the order of the printing head 3E and the printing head 3F from the front side to the rear side in the direction B1. Further, in the printing head 3E, nozzle rows are arranged in the order of a nozzle row that discharges cyan ink, a nozzle row that discharges magenta ink, a nozzle row that discharges yellow ink, and a nozzle that discharges black ink a nozzle row that discharges gray ink, a nozzle row that discharges red ink, a nozzle row that discharges light magenta ink, and a nozzle row that discharges light cyan ink from left to right in FIG. 3 in the main scanning direction A, and in the printing head 3F, nozzle rows are arranged in the order of four nozzle rows that discharge burnish ink and four nozzle rows that discharge white ink from left to right in FIG. 3 in the main scanning direction A. Further, the ultraviolet irradiation unit 4E includes a cover 4*e*1 and a light source 4*e*2.

Figure 7:
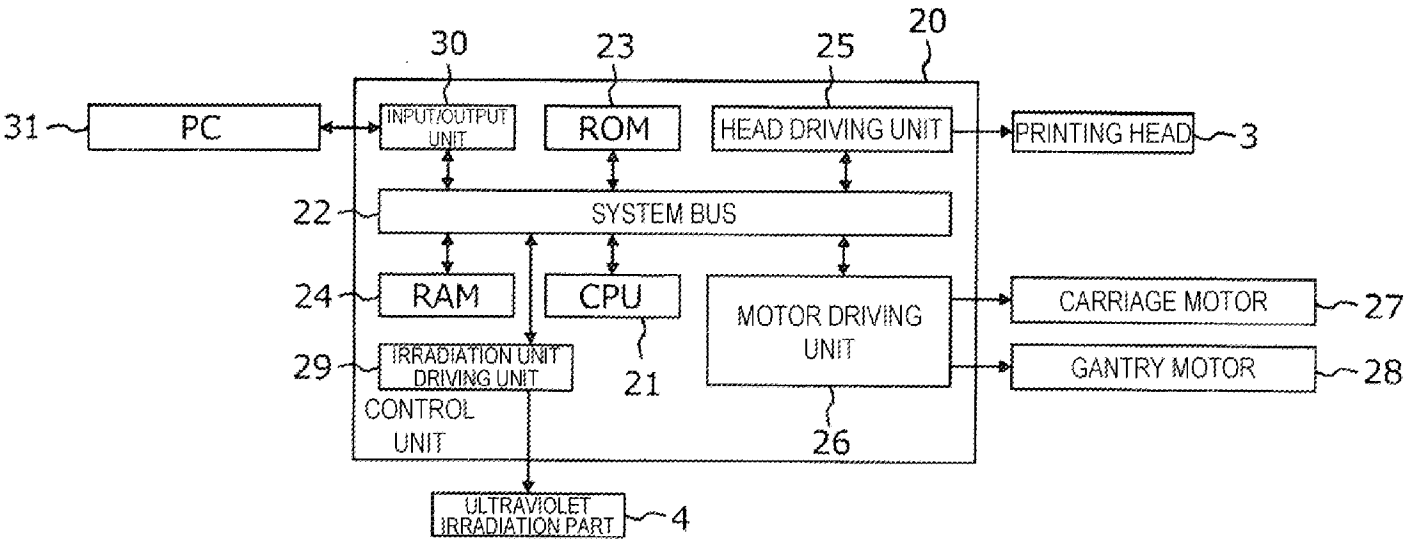
FIG. 7 is a block diagram illustrating an electrical configuration of the printing apparatus according to the embodiment of the present disclosure.

Next, an electrical configuration of the printing apparatus 1 of the present embodiment illustrated in FIGS. 1 to 5 will be described with reference to FIG. 7. The same applies to the electrical configuration of the printing apparatus 11 illustrated in FIG. 6. As illustrated in FIG. 7, the printing apparatus 1 according to the present embodiment includes a control unit 20. The control unit 20 includes a CPU 21 that manages control of the entire printing apparatus 1. The CPU 21 is coupled through a system bus 22 to a ROM 23 that stores, for example, various types of control programs to be implemented by the CPU 21, and a RAM 24 that can temporarily store data.

The CPU 21 is coupled through the system bus 22 to a head driving unit 25 for driving the printing head 3 that discharges ultraviolet curable ink. Further, the CPU 21 is coupled through the system bus 22 to an irradiation unit driving unit 29 for driving the ultraviolet irradiation unit 4.

Furthermore, the CPU 21 is coupled through the system bus 22 to a motor driving unit 26 that is coupled to a carriage motor 27 and a gantry motor 28. Here, the carriage motor 27 is a motor for reciprocating, in the main scanning direction A, the carriage 2 on which each printing head 3 and the like are mounted. Further, the gantry motor 28 is a motor for reciprocating the gantry 5 in the sub scanning direction B.

Furthermore, the CPU 21 is coupled through the system bus 22 to an input-output unit 30 that is coupled to a PC 31 for receiving and transmitting data such as print data and signals.

Here, the printing apparatus 1 according to the present embodiment includes, in the carriage 2, the printing head 3 configured to reciprocate in the main scanning direction A as a first direction and to discharge ultraviolet curable ink onto the medium M, and the ultraviolet irradiation unit 4 configured to reciprocate together with the printing head 3 in the main scanning direction A and to irradiate the ultraviolet curable ink discharged to the medium M with ultraviolet rays. Furthermore, the carriage 2 and the carriage motor 27 serve as a first movement unit that moves the printing head 3 and the ultraviolet irradiation unit 4 in the main scanning direction A, and the gantry 5 and the gantry motor 28 serve as a second movement unit that relatively moves the carriage 2 and the medium M in the sub scanning direction B as a second direction that intersects with the first direction. Then, the control unit 20 controls a first movement, which is a movement of the carriage 2 in the main scanning direction A, a second movement, which is a relative movement between the gantry 5 and the medium M in the sub scanning direction B, and discharge of ultraviolet curable ink from the printing head 3, and irradiation of ultraviolet rays from the ultraviolet irradiation unit 4. Hereinafter, a printing method that can be performed by the printing apparatus 1 of the present embodiment, which is performed under the control by the control unit 20, will be described with reference to FIGS. 8 and 9.

First, a printing method that can be performed by the printing apparatus 1 according to the present embodiment illustrated in a flowchart of FIG. 8 will be described. In the printing method according to the present embodiment, first, in step S110, print data is input from the PC31 or the like.

Next, in step S120, the control unit 20 performs a first control by controlling each component in the printing apparatus 1. Here, the first control is a control by the control unit 20 that moves the carriage 2 from the print start position Ps side of the medium M to the print end position Pe side of the medium M. In the first control, the control unit 20 further performs discharge of ultraviolet curable ink from the printing head 3 and irradiation of ultraviolet rays from the ultraviolet irradiation unit 4 while performing the first movement and the second movement. In the printing method of the present embodiment illustrated by the flowchart of FIG. 8, the first control completes the discharge of the ultraviolet curable ink onto the medium M.

Next, in step S130, the control unit 20 performs a second control by controlling each component in the printing apparatus 1, and ends the printing method of the present embodiment with the end of this step. Here, the second control is a control by the control unit 20 that moves the carriage 2 from the print end position Pe side to the print start position Ps side. In the second control, the control unit 20 further performs irradiation of ultraviolet rays from the ultraviolet irradiation unit 4 without performing discharge of ultraviolet curable ink from the printing head 3, while performing the first movement and the second movement. That is, in the printing method of the present embodiment illustrated by the flowchart of FIG. 8, the second control corresponds to an additional ultraviolet irradiation treatment that complements the irradiation of ultraviolet rays performed during the first control.

As described above, in the printing method according to the present embodiment, in addition to the first control of performing discharge of the ultraviolet curable ink from the printing head 3 and irradiation of the ultraviolet rays from the ultraviolet irradiation unit 4 while performing the first movement and the second movement from the print start position Ps side to the print end position Pe side, the second control of performing irradiation of the ultraviolet rays from the ultraviolet irradiation unit 4 without performing discharge of the ultraviolet curable ink from the printing head 3 while performing the first movement and the second movement from the end position Pe side to the print start position Ps side, is performed.

Therefore, in addition to the first control, the second control can firmly irradiate ultraviolet rays, and ultraviolet curable ink can be securely cured. Further, in the second control, the time for the carriage 2 to return from the print end position Pe side to the print start position Ps side, that is, the time for the carriage 2 to return to the home position is the time required for the additional ultraviolet irradiation treatment. Therefore, by performing the printing method according to the present embodiment, time can be efficiently used.

Further, in the printing apparatus 1 according to the present embodiment, the control by the control unit 20 causes a second speed, which is a movement speed of the first movement of the carriage 2 in the second control of step S130, to be faster than a first speed, which is a movement speed of the first movement of the carriage 2 in the first control of step S120. Therefore, the second control can be performed in a short time, and a decrease in throughput can be suppressed. Here, "causes the second speed to be faster" not only means that the speed during moving operation in the reciprocation of the carriage 2 along the main scanning direction A is fast, but also means that stopping time when moving from the movement in the forward direction A1 to the movement of the return direction A2, and stopping time when moving from the movement of the return direction A2 to the movement of the forward direction A1, are short even when the speed during the moving operation is the same, and the like.

Further, in the printing apparatus 1 according to the present embodiment, the control by the control unit 20 can cause a second relative movement speed, which is a speed of relative movement in the second movement in the second control of step S130, to be faster than a first relative movement speed, which is a speed of relative movement in the second movement in the first control of step S120. With this configuration, in addition to the second speed in the second control, the second relative movement speed in the second control becomes also fast, so that the second control can be performed at particularly short time, and a decrease in throughput can be effectively suppressed. Here, "cause the second relative movement speed to be faster" not only means that the speed during moving operation of the gantry 5 is fast, but also means that, for example, when the gantry 5 is moved intermittently, an amount of one movement of the gantry 5 associated with the intermittent movement is large or stopping time of the gantry 5 associated with the intermittent movement is short even when the speed during the moving operation is the same.

Further, in the printing method according to the present embodiment, the control unit 20 performs the first control and the second control such that a curing degree of the ultraviolet curable ink discharged onto the medium M on which the second control was performed in step S130 after the first control was performed in step S120, is equal to or greater than 97%. Therefore, it is suppressed that the ultraviolet curable ink discharged to the medium M is insufficiently cured after the second control has been performed, and therefore an image formed on the medium M is prevented from being damaged or hands and the like of operator that touched the ultraviolet curable ink discharged onto the medium M are prevented from becoming dirty.

Further, in the printing method according to the present embodiment, the control unit 20 performs the first control such that a curing degree of the ultraviolet curable ink discharged onto the medium M on which the first control was performed in step S120 is equal to or greater than 50%. As a result, the ultraviolet curable ink discharged onto the medium M after the performance of the first control is sufficiently temporarily cured to suppress position shift and bleeding. Therefore, deterioration of image quality is suppressed. Further, since curing degree of the ultraviolet curable ink required for the second control is less than 50%, it becomes easy to perform the second control in a shorter time than the first control.

Furthermore, in the printing method according to the present embodiment, the control unit 20 performs control such that an integrated irradiation amount of the ultraviolet rays from the ultraviolet irradiation unit 4 in the second control of step S130 is less than an integrated irradiation amount of the ultraviolet rays from the ultraviolet irradiation unit 4 in the first control of step S120. In the printing method according to the present embodiment, it is possible to make irradiation intensity of ultraviolet rays from the ultraviolet irradiation unit 4 equal in the first control and the second control, and as described later, it is possible to make irradiation intensity of ultraviolet rays from the ultraviolet irradiation unit 4 in the second control higher than irradiation intensity of ultraviolet rays from the ultraviolet irradiation unit 4 in the first control. In this case, by controlling the integrated irradiation amount of ultraviolet rays from the ultraviolet irradiation unit 4 in the second control to be less than the integrated irradiation amount of ultraviolet rays from the ultraviolet irradiation unit 4 in the first control, the second control can be performed in a short period of time.

Therefore, by performing the second control in a short time, a decrease in throughput can be efficiently suppressed.

Further, as described above, the printing apparatus 1 of the present embodiment includes the cleaning unit 8 configured to clean the printing head 3, and the cleaning unit 8 cleans the printing head 3 according to the control by the control unit 20. Here, the control unit 20 can control the irradiation intensity of the ultraviolet rays from the ultraviolet irradiation unit 4 in the second control of step S130 to be higher than the irradiation intensity of the ultraviolet rays from the ultraviolet irradiation unit 4 in the first control of step S120. Then, when such a control is performed, a cleaning frequency of the printing head 3 by the cleaning unit 8 in the second control can be controlled to be higher than a cleaning frequency of the printing head 3 by the cleaning unit 8 in the first control. When irradiation intensity is increased, ultraviolet rays may reach the nozzle N or the like of the printing head 3, and ultraviolet curable ink in the nozzle N may be cured. However, by increasing the cleaning frequency, the cured ultraviolet curable ink can be appropriately removed, and thus nozzle clogging or the like can be prevented from occurring.

Next, a printing method that can be performed by the printing apparatus 1 according to the present embodiment illustrated in a flowchart of FIG. 9 will be described. Since step S110 and step S120 in the printing method of the present embodiment are the same as the printing method illustrated in the flowchart of FIG. 8, detailed description thereof will be omitted. However, step S130 in the printing method of the present embodiment is different from the printing method illustrated in the flowchart of FIG. 8 in that the first movement and the irradiation of ultraviolet rays from the ultraviolet irradiation unit 4 are not performed.

Figure 9:
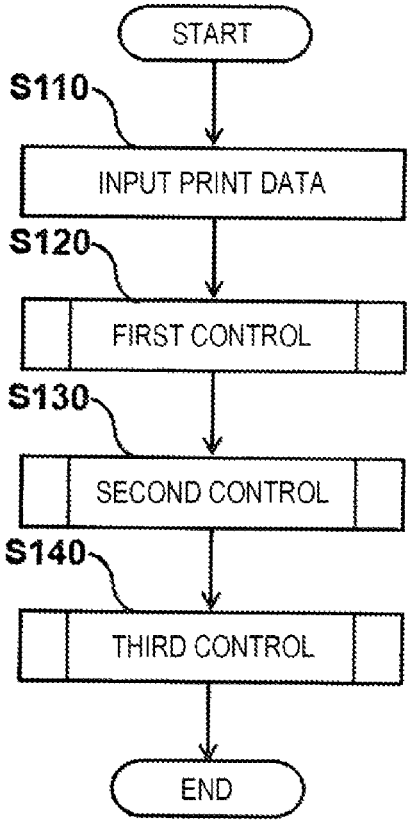
FIG. 9 is a flowchart of another printing method from FIG. 5 that can be performed using the printing apparatus according to the embodiment of the present disclosure.

In the printing method according to the present embodiment, as illustrated in FIG. 9, a third control in step S140 is performed after the end of step S130. The third control is a control by the control unit 20 that moves the carriage 2 from the print start position Ps side to the print end position Pe side. Further, in the third control, the control unit 20 performs irradiation of the ultraviolet rays from the ultraviolet irradiation unit 4 without performing discharge of the ultraviolet curable ink from the printing head 3 while performing the first movement and the second movement. In other words, in addition to the first control of performing discharge of the ultraviolet curable ink from the printing head 3 and irradiation of the ultraviolet rays from the ultraviolet irradiation unit 4 while performing the first movement and the second movement of the carriage 2 from the print start position Ps side to the print end position Pe side, and the second control of moving the carriage 2 from the end position Pe side to the print start position Ps side, the third control of performing irradiation of the ultraviolet rays from the ultraviolet irradiation unit 4 without performing discharge of the ultraviolet curable ink from the printing head 3 while performing the first movement and the second movement of the carriage 2 from the print start position Ps side to the print end position Pe side, is performed. Therefore, in addition to the first control, in the third control, ultraviolet rays can be firmly irradiated, and ultraviolet curable ink can be surely cured.

Further, in the printing apparatus 1 according to the present embodiment, the control by the control unit 20 causes a second speed, which is a movement speed of the carriage 2 in the third control of step S140, to be faster than a first speed, which is a movement speed of the first movement of the carriage 2 in the first control of step S120. Therefore, the third control can be performed in a short time, and a decrease in throughput can be suppressed.

Further, in the printing apparatus 1 according to the present embodiment, the control by the control unit 20 can cause a second relative movement speed, which is a speed of relative movement of the second movement in the third control of step S140, to be faster than the first relative movement speed, which is a speed of relative movement of the second movement in the first control of step S120. With this configuration, in addition to the second speed in the third control, the second relative movement speed in the third control becomes also fast, so that the third control can be performed at particularly short time, and a decrease in throughput can be effectively suppressed.

Further, in the printing method according to the present embodiment, the control unit 20 performs the first control, the second control, and the third control such that a curing degree of the ultraviolet curable ink discharged onto the medium M on which the third control in step S140 was performed after the first control in step S120 and the second control in step S130 were performed, is equal to or greater than 97%. Therefore, it is suppressed that the ultraviolet curable ink discharged onto the medium M is insufficiently cured after the third control is performed, and therefore an image formed on the medium M is prevented from being damaged or hands and the like of operator that touched the ultraviolet curable ink discharged onto the medium M are prevented from becoming dirty.

Figure 8:
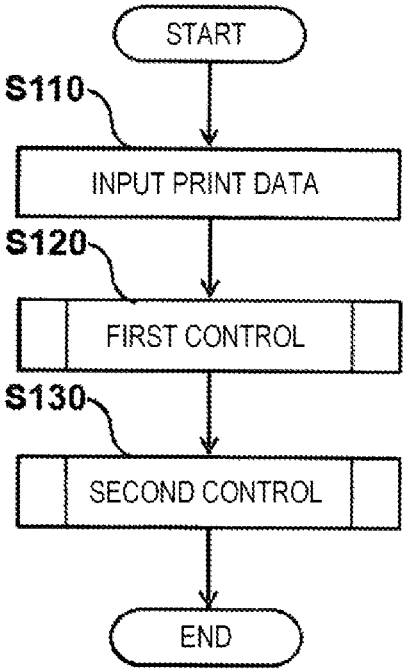
FIG. 8 is a flowchart of a printing method that can be performed using the printing apparatus according to the embodiment of the present disclosure.

In the printing method according to the present embodiment, similar to the printing method illustrated in the flowchart of FIG. 8, the control unit 20 performs the first control such that a curing degree of the ultraviolet curable ink discharged onto the medium M on which the first control in step S120 was performed is equal to or greater than 50%. As a result, the ultraviolet curable ink discharged onto the medium M after the performance of the first control is sufficiently temporarily cured to suppress position shift and bleeding. Therefore, deterioration of image quality is suppressed. Further, since curing degree of the ultraviolet curable ink required for the third control is less than 50%, it becomes easy to perform the third control in a shorter time than the first control.

Furthermore, in the printing method according to the present embodiment, the control unit 20 performs control such that an integrated irradiation amount of the ultraviolet rays from the ultraviolet irradiation unit 4 in the third control of step S140 is less than an integrated irradiation amount of the ultraviolet rays from the ultraviolet irradiation unit 4 in the first control of step S120. In the printing method according to the present embodiment, for example, it is possible to make irradiation intensity of ultraviolet rays from the ultraviolet irradiation unit 4 equal in the first control and the third control, and as described later, it is possible to make irradiation intensity of ultraviolet rays from the ultraviolet irradiation unit 4 in the third control higher than irradiation intensity of ultraviolet rays from the ultraviolet irradiation unit 4 in the first control. In this case, by controlling the integrated irradiation amount of the ultraviolet rays from the ultraviolet irradiation unit 4 in the third control to be less than the integrated irradiation amount of the ultraviolet rays from the ultraviolet irradiation unit 4 in the first control, the third control can be performed in a short period of time. Therefore, by performing the third control in a short time, a decrease in throughput can be efficiently suppressed.

Further, the control unit 20 can control an irradiation intensity of the ultraviolet rays from the ultraviolet irradiation unit 4 in the third control of step S140 to be higher than the irradiation intensity of the ultraviolet rays from the ultraviolet irradiation unit 4 in the first control of step S120. Then, when such a control is performed, a cleaning frequency of the printing head 3 by the cleaning unit 8 in the third control can be controlled to be higher than a cleaning frequency of the printing head 3 by the cleaning unit 8 in the first control. Due to the control by the control unit 20 in this way, nozzle clogging and the like can be prevented from occurring.

Note that the disclosure is not limited to the aforementioned example, and many variations are possible within the scope of the disclosure as described in the appended claims. It goes without saying that such variations also fall within the scope of the disclosure. For example, the printing apparatus 1 and the printing apparatus 11 may perform a printing method different from the printing method illustrated in the flowcharts of FIGS. 8 and 9, and may perform only the first control after step S110, and may perform a fourth movement for moving the carriage 2 from the print end position Pe side to the print start position Ps side subsequently to step S130. Further, the movement of the carriage 2 from the print start position Ps side to the print end position Pe side and the movement of the carriage 2 from the print end position Pe side to the print start position Ps side may be performed as many times as necessary. Further, a process according to a printing mode can be performed for each of the first movement to the fourth movement, and for the subsequent movement of the carriage 2 from the print start position Ps side to the print end position Pe side and the movement of the carriage 2 from the print end position Pe side to the print start position Ps side. The printing mode includes a mode in which printing is performed using white ink, color ink, and burnish ink, a mode in which printing is performed using color ink and burnish ink without white ink, a mode in which printing is performed using only color ink, a mode in which white ink is discharged onto the medium M to print a background, and then color ink is discharged thereon to print an image, and a mode in which color ink is discharged onto the medium M to print an image, and then white ink is discharged thereon to print a background. Furthermore, examples of the process according to the printing mode include presence or absence of irradiation of ultraviolet rays from the ultraviolet irradiation unit 4, and if the irradiation is performed, whether the irradiation is performed from the entire ultraviolet irradiation unit 4 or the irradiation is performed for only a part of a region, such as only a region adjacent to the printing head 3 from which ink has been discharged or only a region which is located downstream of the printing head 3 from which the ink has been discharged in a traveling direction of the carriage 2 in the sub scanning direction B, or further, the irradiation intensity of the irradiation unit 4, a combination of the irradiation intensity and an irradiation position of the ultraviolet irradiation unit 4, the movement speed of the first movement, the movement speed of the second movement, and the like, and a combination thereof.

What is claimed is:

1. A printing apparatus comprising:

a printing head configured to reciprocate in a first direction and configured to discharge ultraviolet curable ink onto a medium, an ultraviolet irradiation unit configured to reciprocate in the first direction along with the printing head, and configured to irradiate the ultraviolet curable ink discharged onto the medium with ultraviolet rays, a first movement unit configured to move the printing head and the ultraviolet irradiation unit in the first direction, a second movement unit configured to relatively move the printing head and the ultraviolet irradiation unit, and the medium, in a second direction that intersects with the first direction, and a control unit configured to control a first movement that is a movement of the printing head and the ultraviolet irradiation unit in the first direction, a second movement that is a relative movement between, the printing head and the ultraviolet irradiation unit, and the medium, in the second direction, discharge of the ultraviolet curable ink from the printing head, and irradiation of the ultraviolet rays from the ultraviolet irradiation unit, wherein the control unit is configured to perform a first control of performing discharge of the ultraviolet curable ink from the printing head and irradiation of the ultraviolet rays from the ultraviolet irradiation unit while performing the first movement and the second movement from a print start position side to a print end position side of the medium, and a second control of performing irradiation of the ultraviolet rays from the ultraviolet irradiation unit without performing discharge of the ultraviolet curable ink from the printing head while performing the first movement and the second movement from the print end position side to the print start position side, and a second speed that is a movement speed of the first movement of the printing head and the ultraviolet irradiation unit in the second control is faster than a first speed that is a movement speed of the first movement of the printing head and the ultraviolet irradiation unit in the first control.

2. The printing apparatus according to claim 1, wherein a second relative movement speed that is a speed of the relative movement of the second movement in the second control, is faster than a first relative movement speed that is a speed of the relative movement of the second movement in the first control.

3. The printing apparatus according to claim 1, wherein the control unit performs the first control and the second control such that a curing degree of the ultraviolet curable ink discharged onto the medium, after the control unit performs the second control subsequently to the first control, is equal to or greater than 97%.

4. The printing apparatus according to claim 1, wherein the control unit performs control such that an integrated irradiation amount of the ultraviolet rays from the ultraviolet irradiation unit in the second control is less than an integrated irradiation amount of the ultraviolet rays from the ultraviolet irradiation unit in the first control.

5. The printing apparatus according to claim 1, comprising:

a cleaning unit configured to clean the printing head according to the control by the control unit, wherein the control unit performs control such that irradiation intensity of the ultraviolet rays from the ultraviolet irradiation unit in the second control is higher than irradiation intensity of the ultraviolet rays from the ultraviolet irradiation unit in the first control, and performs control such that a cleaning frequency of the printing head by the cleaning unit in the second control is higher than a cleaning frequency of the printing head by the cleaning unit in the first control.

6. The printing apparatus according to claim 1, wherein the control unit performs the first control such that a curing degree of the ultraviolet curable ink discharged onto the medium, after the control unit performs the first control, is equal to or greater than 50%.

7. A printing apparatus comprising:

a printing head configured to reciprocate in a first direction and configured to discharge ultraviolet curable ink onto a medium, an ultraviolet irradiation unit configured to reciprocate in the first direction along with the printing head, and configured to irradiate the ultraviolet curable ink discharged onto the medium with ultraviolet rays, a first movement unit configured to move the printing head and the ultraviolet irradiation unit in the first direction, a second movement unit configured to relatively move the printing head and the ultraviolet irradiation unit, and the medium, in a second direction that intersects with the first direction, and a control unit configured to control a first movement that is a movement of the printing head and the ultraviolet irradiation unit in the first direction, a second movement that is a relative movement between, the printing head and the ultraviolet irradiation unit, and the medium, in the second direction, discharge of the ultraviolet curable ink from the printing head, and irradiation of the ultraviolet rays from the ultraviolet irradiation unit, wherein the control unit is configured to perform a first control of performing discharge of the ultraviolet curable ink from the printing head and irradiation of the ultraviolet rays from the ultraviolet irradiation unit while performing the first movement and the second movement from a print start position side to a print end position side of the medium, and a second control of moving the printing head and the ultraviolet irradiation unit from the print end position side to the print start position side, and a third control of performing irradiation of the ultraviolet rays from the ultraviolet irradiation unit without performing discharge of the ultraviolet curable ink from the printing head while performing the first movement and the second movement from the print start position side to the print end position side, and a second speed that is a movement speed of the printing head and the ultraviolet irradiation unit in the third control is faster than a first speed that is a movement speed of the first movement of the printing head and the ultraviolet irradiation unit in the first control.

8. The printing apparatus according to claim 7, wherein a second relative movement speed that is a speed of the relative movement of the second movement in the third control, is faster than a first relative movement speed that is a speed of the relative movement of the second movement in the first control.

9. The printing apparatus according to claim 7, wherein the control unit performs the first control, the second control, and the third control such that a curing degree of the ultraviolet curable ink discharged onto the medium, after the control unit performs the third control subsequently to the first control and the second control, is equal to or greater than 97%.

10. The printing apparatus according to claim 7, wherein the control unit performs control such that an integrated irradiation amount of the ultraviolet rays from the ultraviolet irradiation unit in the third control is less than an integrated irradiation amount of the ultraviolet rays from the ultraviolet irradiation unit in the first control.

11. The printing apparatus according to claim 7, comprising:

a cleaning unit configured to clean the printing head according to the control by the control unit, wherein the control unit performs control such that irradiation intensity of the ultraviolet rays from the ultraviolet irradiation unit in the third control is higher than irradiation intensity of the ultraviolet rays from the ultraviolet irradiation unit in the first control, and performs control such that a cleaning frequency of the printing head by the cleaning unit in the third control is higher than a cleaning frequency of the printing head by the cleaning unit in the first control.

* * * * *